US006536298B1

(12) United States Patent
Bellur et al.

(10) Patent No.: US 6,536,298 B1
(45) Date of Patent: Mar. 25, 2003

(54) MODULAR JOYSTICK

(75) Inventors: Ashok Bellur, Peoria, IL (US); Stephen W. Rector, Metamora, IL (US); David E. Wiesehan, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/607,994

(22) Filed: Jun. 30, 2000

(51) Int. Cl.[7] ..... G05G 1/04; G05G 25/00

(52) U.S. Cl. ..... 74/469; 74/471 XY; 74/491; 74/504; 345/161; 345/167; 463/37; 463/38

(58) Field of Search ..... 74/471 XY, 473.33, 74/469, 471 R, 491, 504; 200/6 A; 345/161, 167; 463/38

(56) References Cited

U.S. PATENT DOCUMENTS

| | | | | |
|---|---|---|---|---|
| 3,365,975 A | * | 1/1968 | Hathaway | 74/471 XY |
| 3,666,900 A | * | 5/1972 | Rothweiler et al. | 200/6 A |
| 4,052,578 A | * | 10/1977 | Hoke | 200/6 A |
| 4,849,585 A | | 7/1989 | Vidican et al. | |
| 5,116,180 A | * | 5/1992 | Fung et al. | 74/471 XY |
| 5,261,291 A | | 11/1993 | Schoch et al. | |
| 5,409,079 A | | 4/1995 | Strong et al. | |
| 5,473,235 A | * | 12/1995 | Lance et al. | 74/471 XY |
| 5,701,660 A | | 12/1997 | Javery et al. | |
| 5,841,372 A | * | 11/1998 | Matsumoto | 74/471 XY |
| 5,887,669 A | | 3/1999 | Ostler et al. | |
| 5,924,515 A | | 7/1999 | Stauffer | |
| 6,065,365 A | | 5/2000 | Ostler et al. | |
| 6,104,382 A | * | 8/2000 | Martin et al. | 345/161 |

FOREIGN PATENT DOCUMENTS

| | | | |
|---|---|---|---|
| JP | 2-275176 | * 11/1990 | 74/471 XY |

* cited by examiner

*Primary Examiner*—William C Joyce
(74) *Attorney, Agent, or Firm*—Clifton G. Green; Kelsey L Milman

(57) ABSTRACT

Apparatuses and methods for configuring an input device. The input device includes a first housing, and a moveable member disposed within the first housing and extending a predetermined distance from the housing. A shaft is disposed in part within the first housing and is coupled with the moveable member. The shaft has a first portion extending a distance from the first housing, and the shaft moves as a function of movement of the moveable member. An interchangeable performance pack is coupled with the first housing and with the first portion of the shaft. The interchangeable performance pack includes a second housing and exerts one of several influences on the shaft.

19 Claims, 5 Drawing Sheets

MODULAR JOYSTICK

TECHNICAL FIELD

This invention relates generally to an operator-input device, and more particularly, to a modular operator-input device.

BACKGROUND ART

Conventional joysticks or other operator-input devices exist in a variety of configurations. Some include self-centering devices, some include force feedback type devices, while others include a variety of detent mechanisms. Each joystick however, is configured at the time a manufacture, and changing the joystick from one configuration to another, such as from having a self centering device to having predetermined detents is difficult, if not impossible. Typically such a change requires extensive reworking of the joystick, including replacement of a substantial portion, if not the entire mechanical innards.

DISCLOSURE OF THE INVENTION

The present invention provides apparatuses and methods for configuring an input device. The input device includes a first housing, and a moveable member disposed within the first housing and extending a predetermined distance from the housing. A shaft is disposed in part within the first housing and is coupled with the moveable member. The shaft has a first portion extending a distance from the first housing, and the shaft moves as a function of movement of the moveable member. An interchangeable performance pack is coupled with the first housing and with the first portion of the shaft. The interchangeable performance pack includes a second housing and exerts one of several influences on the shaft.

BEST MODE FOR CARRYING OUT THE INVENTION

Figure 1:
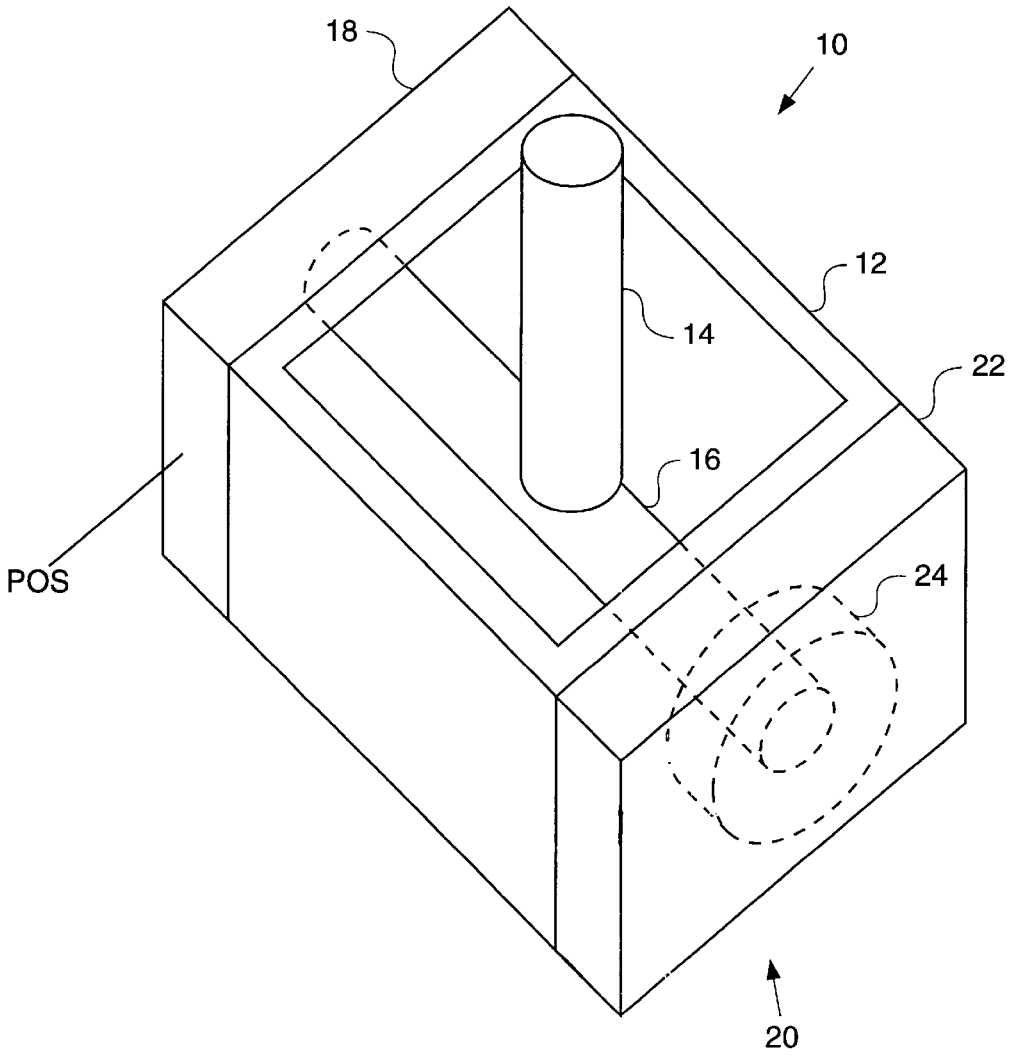
FIG. 1 is a perspective view of an operator-input device according to one embodiment of the invention.

FIG. 1 is a perspective view of an operator-input device 10 according to one embodiment of the invention. The device 10 includes a first housing 12 and a movable member, such as a lever arm or stick 14, disposed within the first housing 12. The stick 14 typically extends a predetermined distance from the first housing 12, and may be configured so as to receive a hand (not shown) of an operator.

A shaft 16 is also disposed in part within the first housing 12, and is coupled with the stick 14. The shaft 16 moves as a function of the movement of the stick 14. In one embodiment of the invention, the shaft 16 rotates as the stick 14 moves along a predetermined axis, typically perpendicular to the axis of the shaft 16. The shaft 16 may be directly coupled with the stick 14 or alternately, intermediate mechanisms (not shown) known to those skilled in the art may be interposed. A first portion of the shaft 16 extends a predetermined distance from the first housing 12, typically through a wall of the first housing 12.

A position sensor 18 may be coupled with the shaft 16. The position sensor 18 transmits a position signal POS as a function of the position, such as the rotational position, of the shaft 16 by any of a variety of appropriate ways known to those skilled in the art.

An interchangeable performance pack 20 is coupled with the first housing 12 and with the first portion of the shaft 16. The performance pack 20 typically includes a second housing 22 and a shaft-influencing device 24 disposed at least in part within the second housing 22. The shaft-influencing device 24 receives a portion of the shaft 16, e.g., the first portion, and exerts one of a plurality of predetermined influences on the shaft 16.

A variety of interchangeable performance packs 20 may be used, each having a different predetermined influence on the shaft 16. The performance pack 20 is typically coupled with the first housing 12 so as to be easily removed/attached, such as by screws, bolts, magnets, or clips, for example. A variety of other ways known to those skilled in the art may also be used. More permanent methods of attaching the performance pack 20 may also be used, such as rivets or welds. These types of attachment, however, would increase the amount time needed to change a performance pack 20 (see below).

Each type of performance pack 20 receives the shaft 16 in the same location, making the different performance packs 20 interchangeable. The use of the second housing 22 makes the performance pack 20 self-contained and modular. Thus, removing a few screws, for example, is all that is needed to change the performance pack 20.

Further, the configuration of an existing operator-input device 10 may be easily changed at anytime, with minimal rework. Mounting the performance pack 20 on the exterior of the first housing 12, rather than inside it as is typical with many conventional operator-input devices 10, assists in this minimization of the rework. Thus, the performance pack 20 may be changed in the field, rather than requiring the entire operator-input device to be shipped back to the manufacturer, as would be necessary with conventional operator-input devices having shaft influencing devices internal to the first housing 12.

Because different types of performance packs may be configured to exert different influences on the shaft 16, the characteristics of the operator-input device 10 may be varied by swapping one type of performance pack 20 for another. For example, a joystick to having a first set of detents may be changed to a joystick having a second set of detents merely by changing the performance pack 20.

Thus, only a single base configuration of the housing 12, the stick 14, and the shaft 16 need be stocked by a manufacturer in order to create a variety of different operator-input devices 10. For example, a variety of joysticks may be created with the following procedure: select a joystick base, couple a movable lever arm with the joystick base, select one of a plurality of interchangeable performance packs, and couple the selected performance pack with the joystick base and lever arm. This method may allow a significant reduction in inventory due to interchangeable parts, leading to substantial cost savings.

Figure 2A:
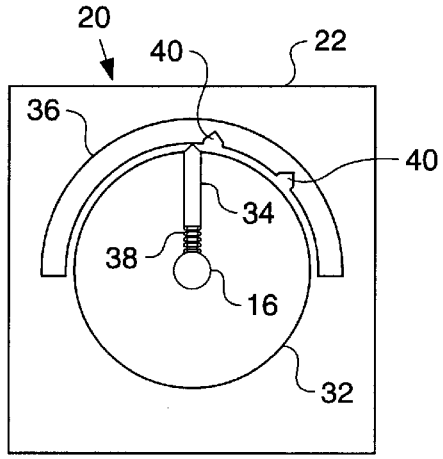
FIG. 2*a* is a cut away view of a performance pack according to one embodiment of invention.

FIG. 2*a* is a cut away view of a performance pack 20, such as a detent pack, according to one embodiment of invention. The performance pack includes a second movable member, such as a disk 32 that receives the shaft 16. Other types and shapes of movable members known to those skilled in the art may also be used. A plunger 34 is coupled with the disk 32, and is biased against a race 36 by a biasing device such as a spring 38. Other types of biasing devices known to those skilled in the art may also be used. In this embodiment, the disk 32, the plunger 34, the race 36, and the spring 38 make up the shaft-influencing device 24 of FIG. 1.

The race 36 is typically fixedly coupled with the housing 22. The race contains a least one indent or recess 40 at a predetermined location. Thus, as the shaft 16 rotates, the plunger 34 rides along the race 36. When the plunger 34 reaches the location of a recess 40, the plunger is pushed into the recess 40 by the spring 38.

As the shaft 16 continues to rotate, the walls of the recess 40 resist further movement of the plunger 34 along the race 36. Typically the disk 32 and the shaft 16 will only rotate after sufficient force is exerted on the shaft 16 to compress the spring 38. Thus, by appropriate selection of the shape of the recess 40, detents may be created for the motion of the shaft 16. The shape of the recess 40 may be any of a variety of shapes known to those skilled in the art. Raised portions (not shown) of the race 36 to may be included adjacent to the recesses 40 for increasing the force required to move the shaft 16 into and out of the recesses 40.

Figure 2B:
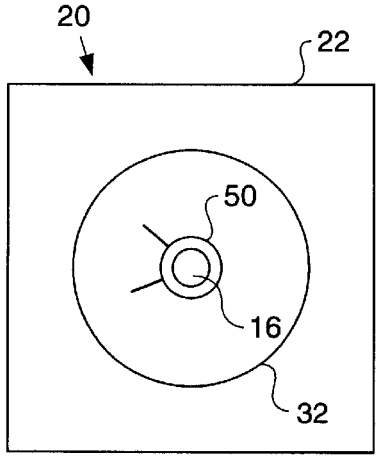
FIG. 2*b* is a cut away view of another performance pack according to one embodiment of invention.

FIG. 2*b* is a cut away view of another performance pack 20, such as a spring pack, according to one embodiment of invention. The second movable member, such as the disk 32 receives the shaft 16. A biasing device, such as a torsional spring 50 is coupled with the disk 32 and housing 22. Other types of biasing devices, such as other types of springs, for example, known to those skilled in the art may also be used. The torsional spring 50 biases the disk 32, and thus the shaft 16, towards a predetermined position by ways known to those skilled in the art.

Figure 2C:
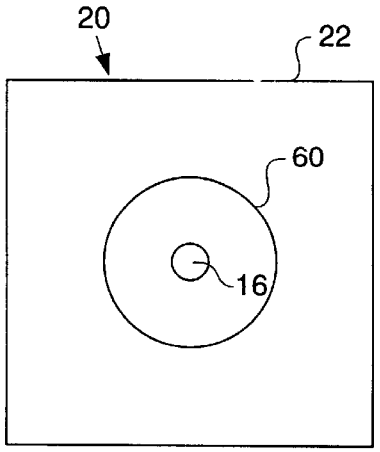
FIG. 2*c* is a cut away view of another performance pack according to one embodiment of invention.

FIG. 2*c* is a cut away view of another performance pack, such as a force feedback pack, according to one embodiment of invention. A force feedback device, such as a motor 60 is coupled with the housing 22. Other types of force feedback devices known to those skilled in the art may also be used. The motor 60 is also coupled with the shaft 16. The motor 60 exerts a rotational force on the shaft 16 in response to control signals (not shown) by ways known to those skilled in the art. Thus, by appropriate control of the motor 60 by ways known to those skilled in the art, force feedback to the shaft 16 and the stick 14 may be effected.

Figure 2D:
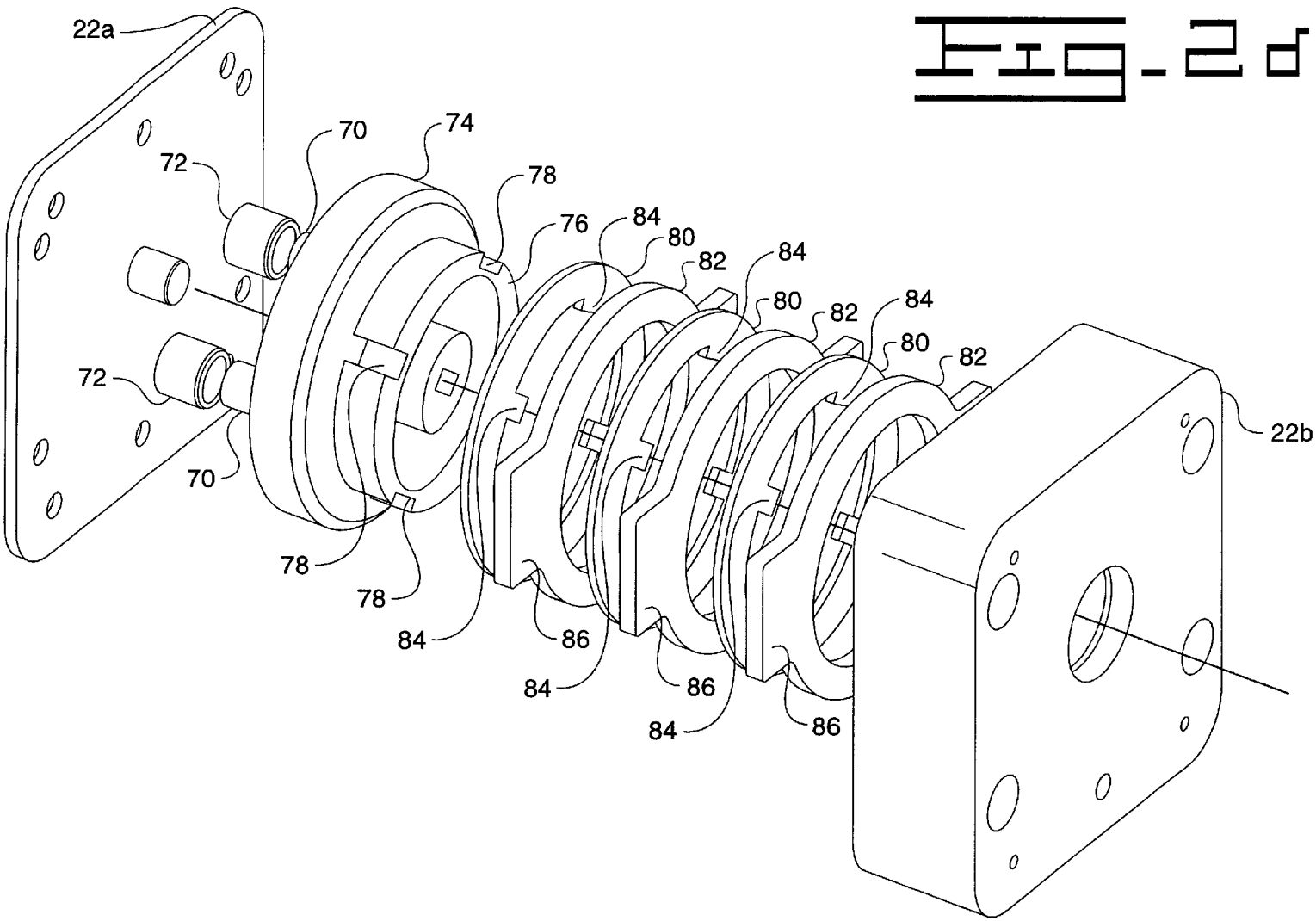
FIG. 2*d* is a cut away view of another performance pack according to one embodiment of invention.

FIG. 2*d* is an exploded view of another performance pack, such as a friction pack, according to one embodiment of invention. The second housing 22 includes a plate 22*a* and a case 22*b*. Compression springs 70 are coupled with the plate 22*a* via spring holders 72. A base disk 74 is affixed to the base plate 22*a*, and is biased towards the case 22*b* by the compression springs 70. A movable disk 76 is coupled with the base disk 74. The movable disk 76 receives the shaft 16 (not shown). The movable disk 76 also contains a least one key recess 78.

Friction rings 80 alternate with and frictionally engage metal rings 82. The friction rings 80 typically include at least one key 84 that mates with the key recesses 78. The metal rings 82 are typically braced within the case 22*a* by braces 86. Other types of friction packs known to those skilled in the art may also be used.

In operation, as the shaft 16 rotates, it causes the movable disk 76 to rotate. Movement of the movable disk 76 causes the friction rings 80 to rotate, pressing against the metal rings 82. The braces 86 prevent the metal rings 82 from rotating. Thus, the friction rings 80 slide against the fixed metal rings 82, creating resistance to the rotation of the shaft 16.

The amount of resistance to the rotation of the shaft 16 may be modified by changing the compression force exerted by the compression springs 70 and by increasing or decreasing the number of friction rings 80 and metal rings 82. Typically the amount of resistance to the rotation of the shaft 16 is calibrated to be of a sufficient magnitude so that the stick 14 remains stationary when released by an operator under normal working conditions (e.g., vibration) for the operator-input device 10.

Referring back to FIG. 1, although the performance pack 20 and the position sensor 18 are shown is being on opposite ends of the shaft 16, they need not be. In one embodiment of the invention, the performance pack 20 and the position sensor 18 are on the same end of the shaft 16. Typically the shaft 16 extends through one of the performance pack 20 and the position sensor 18 and into the other.

Figure 3:
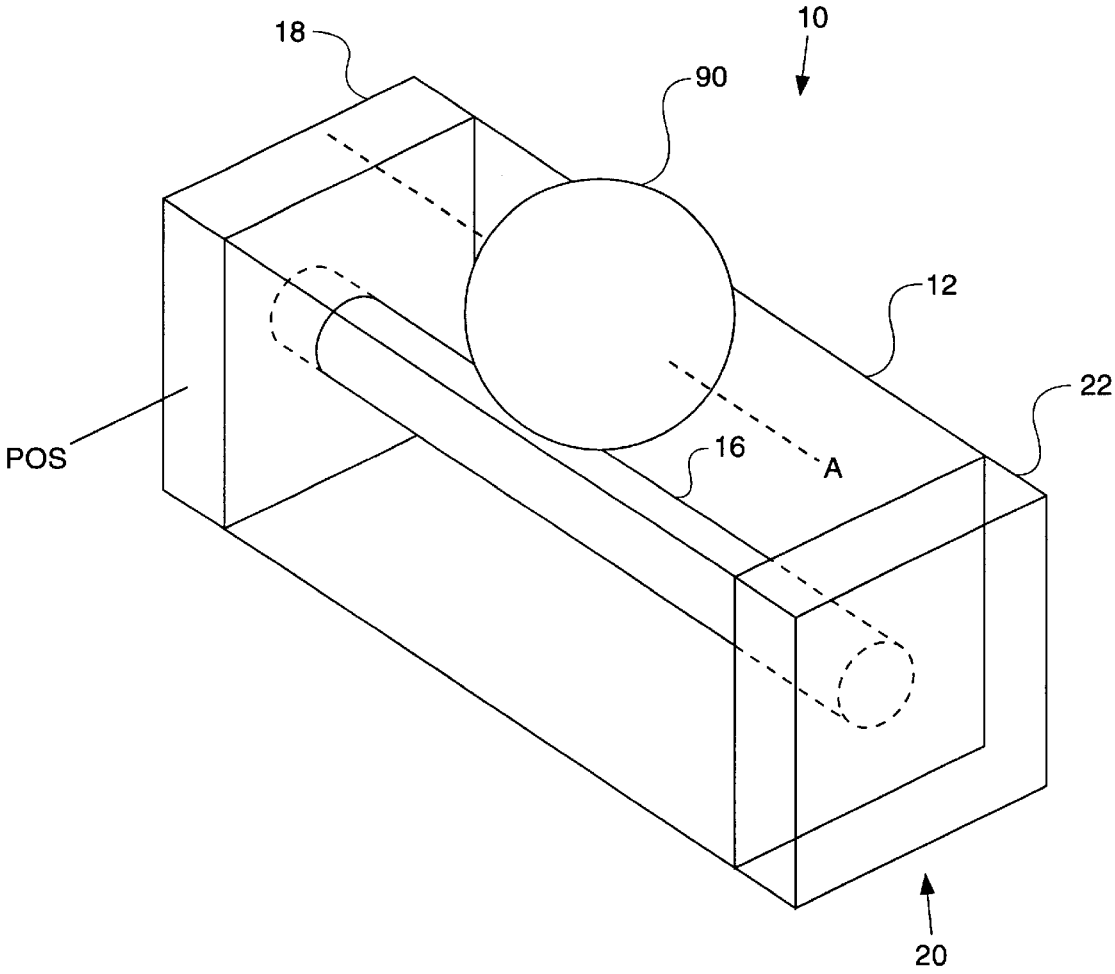
FIG. 3 is a perspective view of an operator input device according to one embodiment of the invention.

FIG. 3 is a perspective view of another operator-input device 10, such as a track ball or mouse, according to one embodiment of the invention. Instead of a stick 14, the operator-input device 10 has a sphere or ball 90 coupled with the shaft 16. The ball 90 typically extends a predetermined distance outside of the housing 12. The ball 90 is typically coupled via friction with the shaft 16, although other methods known to those skilled in the art, such as teeth or belts may also be used. Thus, the shaft 16 tracks the rotation of the ball 90 about an axis ("A") parallel to the axis of the shaft 16. The operator-input device 10 otherwise functions similarly to that which is described FIG. 1, and not be repeated.

Figure 4:
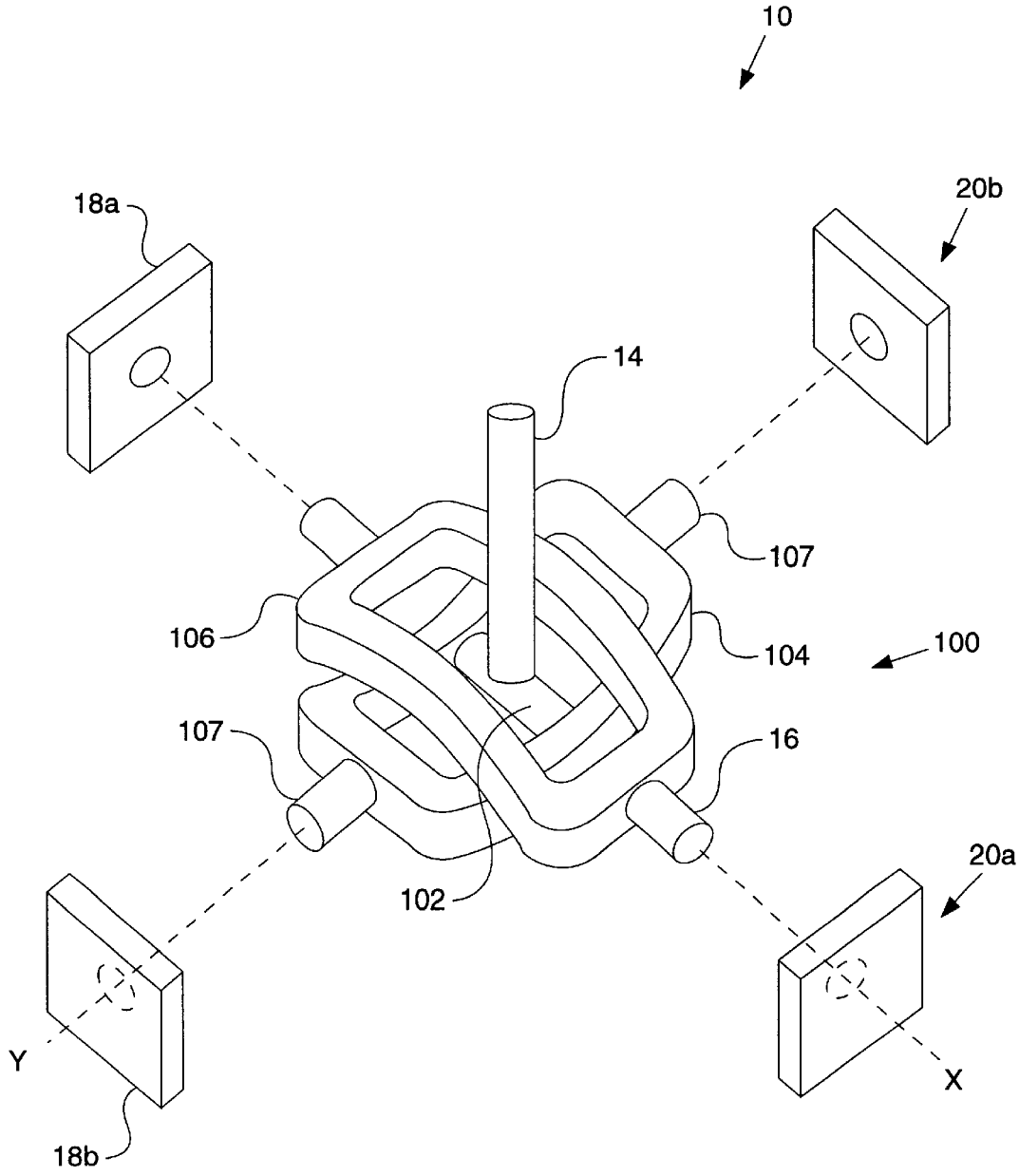
FIG. 4 is an exploded view of a portion of an operator-input device according to one embodiment of the invention.

FIG. 4 is an exploded view of a portion of another operator-input device 10 according to one embodiment of the invention. The operator-input device 10 is a multi-dimensional device. A gimbal arrangement 100 having a second shaft 102 is coupled with the stick 14. The second shaft 102 is coupled with a first gimbal ring 104, which is in turn coupled with a second gimbal ring 106. The shaft 16 is coupled with the second gimbal ring 106. A third shaft 107 is coupled with the first gimbal ring 104.

In operation, as the stick 14 moves along the Y-axis, it causes the second shaft 102 in the second gimbal ring 106 to rotate. As the second gimbal ring 106 rotates, it causes the shaft 16 to rotate. A first performance pack 20*a* and a first position sensor 18*a* are coupled with the shaft 16 and function as described above. Typically the second shaft 102 rotates about the X-axis within the first gimbal ring 104. Thus, the first gimbal ring 104 does not rotate about the X-axis.

As the stick 14 moves along the X-axis, it causes the first gimbal ring 104 and the third shaft 107 to rotate about the Y-axis. A second performance pack 20*b* and a second position sensor 18*b* are coupled with the third shaft 107, and functions similarly to what is described above.

Note that the shapes and configurations of the first and second gimbal rings 104, 106 are such that rotation of one gimbal ring 104, 106 does not cause any rotation in the other gimbal ring 104, 106. Any of a variety of appropriate shapes known to those skilled in the art may be used for the first and second gimbal rings 104, 106. Other gimbal arrangements 100 or similar devices known to those skilled in the art may also be used.

INDUSTRIAL APPLICABILITY

The operator-input device 10 may be used in a variety of ways. It may be used as an input device for computers or video games, or as controller for a variety of work machines known to those skilled in the art, such as a tractor, a wheel loader, a scraper, a motor grader, a military tank, etcetera. With respect to work machines, the position signals corresponding to the position(s) of the shaft(s) 16, 107 may be used as inputs for the positioning of various tools, such as blades or buckets for example, coupled with the work machines, or as directional, e.g., steering, inputs.

From the foregoing it will be appreciated that, although specific embodiments of the invention have been described herein for purposes of illustration, various modifications may be made without deviating from the spirit or scope of the invention. Accordingly, the invention is not limited except as by the appended claims.

What is claimed is:

1. An input device, comprising:

a first housing;

a moveable member disposed within the first housing and extending a predetermined distance from the housing;

a shaft disposed in part within the first housing and coupled with the moveable member, the shaft having a first portion extending a predetermined distance from the first housing, the shaft operable to move as a function of movement of the moveable member;

a first interchangeable performance pack coupled with the first housing and with the first portion of the shaft, the first interchangeable performance pack including a second housing and operable to exert one of a plurality of predetermined influences on the shaft.

2. The input device of claim 1 wherein the first performance pack comprises a spring pack, the spring pack operable to bias the shaft towards a predetermined position.

3. The input device of claim 1 wherein the first performance pack comprises a detent pack, the detent pack operable to exert a first predetermined resistance to the movement of the shaft when the shaft is in a first predetermined position and to exert a second predetermined resistance to the movement of the shaft when the shaft is in a second predetermined location.

4. The input device of claim 1 wherein the first performance pack comprises a friction pack, the friction pack operable to exert a predetermined force resisting the movement of the shaft.

5. The input device of claim 1 wherein the first performance pack comprises a force feedback device.

6. The input device of claim 1 wherein the first interchangeable performance pack is coupled with an exterior of the first housing.

7. The input device of claim 1 wherein the first interchangeable performance pack comprises:

a shaft influencing device disposed within the second housing, the shaft influencing device operable to be coupled with the shaft and to exert the predetermined influence on the shaft, and wherein the second housing is operable to be coupled with the first housing.

8. The input device of claim 1, further comprising a position sensor coupled with the shaft, the position sensor operable to transmit a position signal as a function of the rotational position of the shaft.

9. The input device of claim 8 wherein the shaft includes a second portion extending a predetermined distance from the housing, and the shaft position sensor is coupled with the second portion of the shaft.

10. The input device of claim 1 wherein the moveable member comprises a lever arm.

11. The input device of claim 1 wherein the moveable member comprises a ball.

12. The input device of claim 1 wherein the shaft is operable to rotate as a function of movement of the moveable member along a predetermined axis.

13. The input device of claim 1, further comprising:

a second shaft disposed in part within the first housing and having a first portion extending a predetermined distance from the first housing, the second shaft being coupled with the moveable member; and a second interchangeable performance pack coupled with the first housing and with the first portion of the second shaft, the second interchangeable performance pack including a third housing and operable to exert a predetermining influence on the second shaft.

14. The input device of claim 13, further comprising a gimbal arrangement coupled between the moveable member and the second shaft.

15. The input device of claim 13, further comprising a position sensor coupled with the second shaft, the position sensor operable to transmit a position signal as a function of the rotational position of the second shaft.

16. A configurable joystick, comprising:

a housing;

a lever arm disposed in part within the housing and extending a predetermined distance from the housing;

a gimbal arrangement disposed within the housing, the gimbal arrangement including a first and second shafts extending a first and second predetermined distances from the housing, the first shaft and second shaft coupled with the lever arm and operable to respectively rotate as a function of the movement of the lever arm along a respective first and second predetermined axes;

a first interchangeable performance pack coupled with the exterior of the housing and with the portion of the first shaft extending from the housing, the first interchangeable performance pack operable to exert a first predetermined influence on the first shaft;

a second interchangeable performance pack coupled with the exterior of the housing and with the portion of the second shaft extending from the housing, the second interchangeable performance pack operable to exert a second predetermined influence on the second shaft;

a first position sensor coupled with the lever arm, the first position sensor operable to transmit a first position signal as a function of the position of the lever arm along a first predetermined axis; and a second position sensor coupled with the lever arm, the second position sensor operable to transmit a second position signal as a function of the position of the lever arm along a second predetermined axis.

17. A method of constructing a modular joystick, comprising selecting a joystick base, the joystick base including a shaft;

coupling a moveable lever arm with the joystick base, the lever arm operable to move relative to the joystick base;

selecting one of a plurality of interchangeable performance packs operable to exert one of a plurality of predetermined characteristics on the moveable lever arm; and coupling the performance pack with the joystick base and with the shaft.

18. The method of claim 17 wherein the joystick base comprises a housing and a gimbal arrangement, the gimbal arrangement comprising the shaft, the shaft extending a predetermined distance from the housing, wherein coupling the movable lever arm with the joystick base comprises coupling the lever arm with the gimbal arrangement.

19. The method of claim 17 wherein the joystick base includes a housing and coupling the performance pack comprises coupling the performance pack with the exterior of the housing.

* * * * *